US008528755B2

(12) United States Patent
Kurotsu

(10) Patent No.: US 8,528,755 B2
(45) Date of Patent: Sep. 10, 2013

(54) MOBILE CRANE HAVING COUNTERWEIGHT

(75) Inventor: Hitoshi Kurotsu, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 284 days.

(21) Appl. No.: 13/022,190

(22) Filed: Feb. 7, 2011

(65) Prior Publication Data

US 2011/0192815 A1 Aug. 11, 2011

(30) Foreign Application Priority Data

Feb. 9, 2010 (JP) ..... 2010-026533

(51) Int. Cl.
*B66C 23/76* (2006.01)

(52) U.S. Cl.
USPC ..... 212/196

(58) Field of Classification Search
USPC ..... 212/178, 195–198, 279, 308; 414/673, 414/719; 187/404, 405
See application file for complete search history.

(56) References Cited

U.S. PATENT DOCUMENTS

| | | | | |
|---|---|---|---|---|
| 3,842,984 | A * | 10/1974 | Brown et al. | 212/195 |
| 3,955,844 | A * | 5/1976 | de Castella et al. | 294/67.1 |
| 4,716,729 | A * | 1/1988 | Kakeya | 60/426 |
| 4,953,722 | A | 9/1990 | Becker et al. | |
| 2008/0203045 | A1 * | 8/2008 | Pech et al. | 212/270 |

FOREIGN PATENT DOCUMENTS

| | | | |
|---|---|---|---|
| CN | 101021731 | A | 8/2007 |
| CN | 101309850 | A | 11/2008 |
| CN | 201321353 | Y | 10/2009 |
| DE | 44 18 785 | A1 | 11/1995 |
| EP | 0 368 463 | A1 | 5/1990 |
| JP | 49-125467 | U | 10/1974 |
| JP | 55-174083 | U | 12/1980 |
| JP | 62-175398 | | 8/1987 |
| JP | 5-140964 | | 6/1993 |
| JP | 9-227076 | | 9/1997 |
| JP | 2000-54435 | | 2/2000 |
| JP | 2008-297112 | | 12/2008 |
| KR | 10-2009-0069376 | | 7/2009 |

OTHER PUBLICATIONS

Extended Search Report issued May 26, 2011 in Europe Application No. 11153655.3.
Combined Chinese Office Action and Search Report issued Dec. 3, 2012 in Chinese Patent Application No. 201110036146.8 (with English Summary and English Translation of Category of Cited Documents).

* cited by examiner

*Primary Examiner* — Emmanuel M Marcelo
*Assistant Examiner* — Angela Caligiuri
(74) *Attorney, Agent, or Firm* — Oblon, Spivak, McClelland, Maier & Neustadt, L.L.P.

(57) ABSTRACT

Provided is a mobile crane capable of adjusting a counterweight height with no use of a costly hydraulic cylinder. The mobile crane comprises a lower propelling body, a upper slewing body, a boom pivotably attached to the upper slewing body, a mast which is at the rear of the boom and adapted to be raised and lowered so as to raise and lower the boom, a counterweight which is at the rear of the upper slewing body and hung from the mast through a guy line, and a counterweight-lifting cylinder attached to the counterweight so as to be extended to vertically push up the counterweight with respect to a ground surface. The counterweight-lifting cylinder has a cylinder body, a piston partitioning an internal space of the cylinder body into an upper head-side cylinder chamber and a lower rod-side cylinder chamber, and a rod extending from the piston downwardly beyond an lower end of the cylinder body. the counterweight-lifting cylinder is extended by supply of a hydraulic pressure into the head-side cylinder chamber and retracted by supply of a hydraulic pressure into the rod-side cylinder chamber.

2 Claims, 8 Drawing Sheets

MOBILE CRANE HAVING COUNTERWEIGHT

BACKGROUND OF THE INVENTION

1. Field of the Invention

The present invention relates to a mobile crane having a counterweight.

2. Description of the Background Art

Heretofore, there has been known a large mobile crane having a counterweight for increasing a lifting capacity. For example, JP 2008-297112 A discloses a mobile crane which comprises a lower propelling body, a upper slewing body adapted to be slewed on the lower propelling body, a lattice-structured mast attached to the upper slewing body, and a counterweight hung from an upper end of the mast through a guy line, at a position rearward of the upper slewing body. In this type of mobile crane, a crane lifting capacity is adjusted by changing a horizontal distance between a mast foot which is a supported point of a base end of the mast and a center of gravity of the counterweight (the horizontal distance will hereinafter be referred to as "hanging radius of the counterweight"), or changing a mass of the counterweight. For example, when a boom is moved frontwardly while hanging a load therefrom (an operating radius is increased), the counterweight is moved rearwardly with respect to the upper slewing body to increase the hanging radius of the counterweight.

The hanging radius of the counterweight is adjusted, for example, by changing an angle of the mast. Specifically, the mast is raised and lowered about the mast foot. The raising and lowering movement of the mast, however, involves a vertical displacement of the mast point at the upper end of the mast, which causes the following problems. When the mast is lowered to increase the hanging radius of the counterweight, the counterweight is displaced downwardly and landed on a ground surface, which hinders the counterweight from functioning as a weight, and further hinders a slewing movement of the upper slewing body and a traveling movement of the mobile crane. On the other hand, when the mast is raised to reduce the hanging radius of the counterweight, the counterweight is lifted up from the ground surface: releasing a load in this state may cause the mobile crane to be inclined rearwardly.

To solving the above problems, it is required to preliminarily calculate/measure the mass of the counterweight, the hanging radius of the counterweight, and a length of the guy line for hanging the counterweight (the guy line will hereinafter be referred to as "counterweight guy line"), on a constant basis. The length adjustment of the counterweight guy line, however, requires a lot of time and effort.

As a mobile crane designed taking into account this point, there has heretofore been known one type equipped with a cylinder for changing a substantial length of the counterweight guy line. There are shown two examples of this type of mobile crane in FIGS. 7 and 8.

FIG. 7 shows a mobile crane 101, which comprises a lower propelling body 10, a upper slewing body 20, a boom 25, a mast 30 having a mast point 30*p* provided at an upper end thereof, a counterweight 50, and a counterweight guy line 54 for hanging the counterweight 50 from the mast point 30*p*, wherein a hydraulic cylinder 160 is interposed in an upper portion of the counterweight guy line 54.

The hydraulic cylinder 160 has a cylinder body 162 surrounding an internal space thereof, a piston 164 provided within the cylinder body 162 to partition the internal space into an upper head-side cylinder chamber 160*h* and a lower rod-side cylinder chamber 160*r*, and a rod 166 extending from the piston 164 downwardly beyond an lower end of the cylinder body 162. The hydraulic cylinder 160 is operated to be extended/retracted depending on an angle of the mast 30, by means of supply/discharge of a hydraulic pressure to/from the cylinder chambers 160*h* and 160*r*, thereby allowing an altitudinal height H of the counterweight 50 from a ground surface G (the altitudinal height will hereinafter be referred to as "counterweight height H") to be adjusted.

FIG. 8 shows a mobile crane 201 which comprises, instead of the cylinder 160 of the above mobile crane 101, a counterweight support member 241 interconnecting the upper slewing body 20 and the counterweight guy line 54 and a hydraulic cylinder 260 interposed between the counterweight guy line 54 and the counterweight 50. The counterweight support member 241 is adapted to be extended/retracted in a direction close to a horizontal direction, thereby allow a hanging radius R of the counterweight 50 to be changed without moving the mast 30. This type of crane, involving no displacement of the mast point 30*p*, does not permit a large variation of the counterweight height H; however, if a length of the counterweight guy line 54 was kept constant, the extension/retraction of the counterweight support member 241 could vary the counterweight height H. The hydraulic cylinder 260, which has a structure similar to that of the cylinder 160, is adapted to be extended/retracted in an upward-downward direction to allow the counterweight height H to be adjusted.

However, the above technique, using the hydraulic cylinder 160 or hydraulic cylinder 260 to pull up the counterweight 50 by the retraction of the cylinder, lowers driving efficiency. For example, pulling up the counterweight 50 by use of the hydraulic cylinder 160 shown in FIG. 7 requires a hydraulic fluid to be supplied to the rod-side cylinder chamber 160*r* on the side of the counterweight 50; in the rod-side cylinder chamber 160*r*, the piston 164 has a pressure receiving area smaller than that in the head-side cylinder chamber 160*h* by a cross-sectional area of the rod 166. Therefore, in order to produce a sufficiently large pull-up force despite the relatively small pressure receiving area, it is necessary to increase a hydraulic pressure or increase a diameter of the cylinder 160. Either case requires a costly hydraulic cylinder.

SUMMARY OF THE INVENTION

It is an object of the present invention to provide a mobile crane capable of adjusting a counterweight height with no use of a costly hydraulic cylinder. The present invention provides a mobile crane which comprises: a lower propelling body; a upper slewing body slewably mounted on the lower propelling body; a boom attached to the upper slewing body pivotably; a mast disposed at the rear of the boom and adapted to be raised and lowered so as to raise and lower the boom; a counterweight disposed at the rear of the upper slewing body and hung from the mast through a guy line; and a counterweight-lifting cylinder attached to the counterweight and adapted to be extended so as to vertically push up the counterweight while receiving a reaction force from a ground surface. The counterweight-lifting/lowering cylinder has a cylinder body surrounding an internal space thereof, a piston fitted inside the cylinder body to separate the internal space into an upper head-side cylinder chamber and a lower rod-side cylinder chamber, and a rod extending from the piston downwardly beyond an lower end of the cylinder body, the counterweight-lifting cylinder being adapted to be extended by supply of a hydraulic pressure into the head-side cylinder chamber while be retracted by supply of a hydraulic pressure into the rod-side cylinder chamber.

According to this mobile crane, the counterweight-lifting cylinder can vertically push up the counterweight while receiving a reaction force from a ground surface against the gravity acting on the counterweight, by supply of a hydraulic pressure into the head-side cylinder chamber of the counterweight-lifting cylinder which has a pressure receiving area greater than that of the rod-side cylinder chamber. For this reason, the driving efficiency of the counterweight-lifting cylinder is higher than that of a cylinder required to be retracted to pull up a counterweight against a gravity acting thereon, i.e., a cylinder in which a hydraulic pressure is supplied into a rod-side cylinder chamber having a relatively small pressure receiving area to pull up the counterweight, such as the cylinders 160 and 260 shown in FIGS. 7 and 8. This makes it possible to lift the counterweight with a limited hydraulic pressure for the operation of the hydraulic cylinder and a limited diameter of the hydraulic cylinder, thus enabling the counterweight to be lifted/lowered by use of a low-cost hydraulic cylinder.

DESCRIPTION OF THE PREFERRED EMBODIMENTS

With reference to FIGS. 1 to 6, one embodiment of the present invention will now be described.

Figure 1:
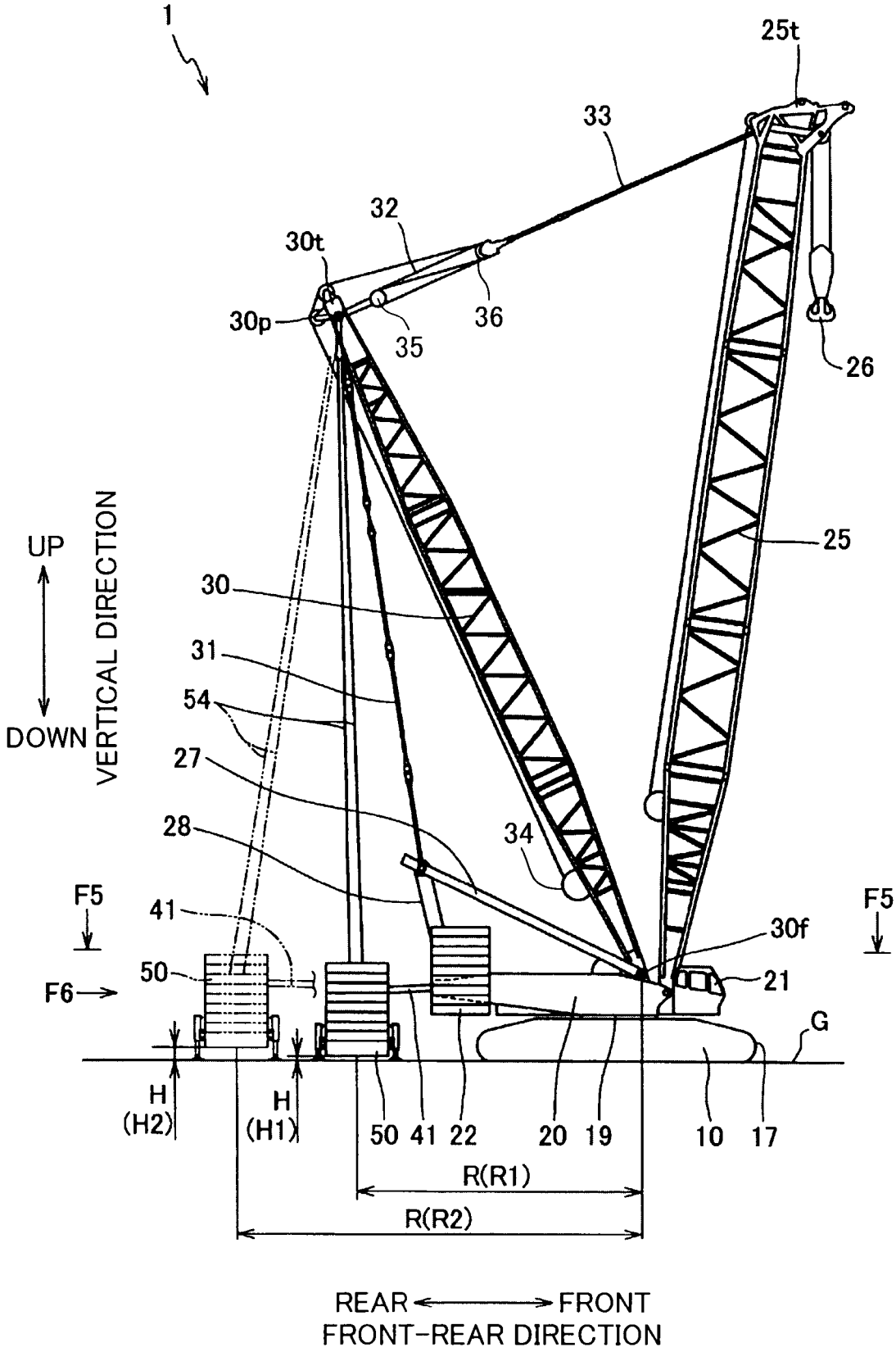
FIG. 1 is an overall view of a mobile crane according to one embodiment of the present invention.
Figure 4A:
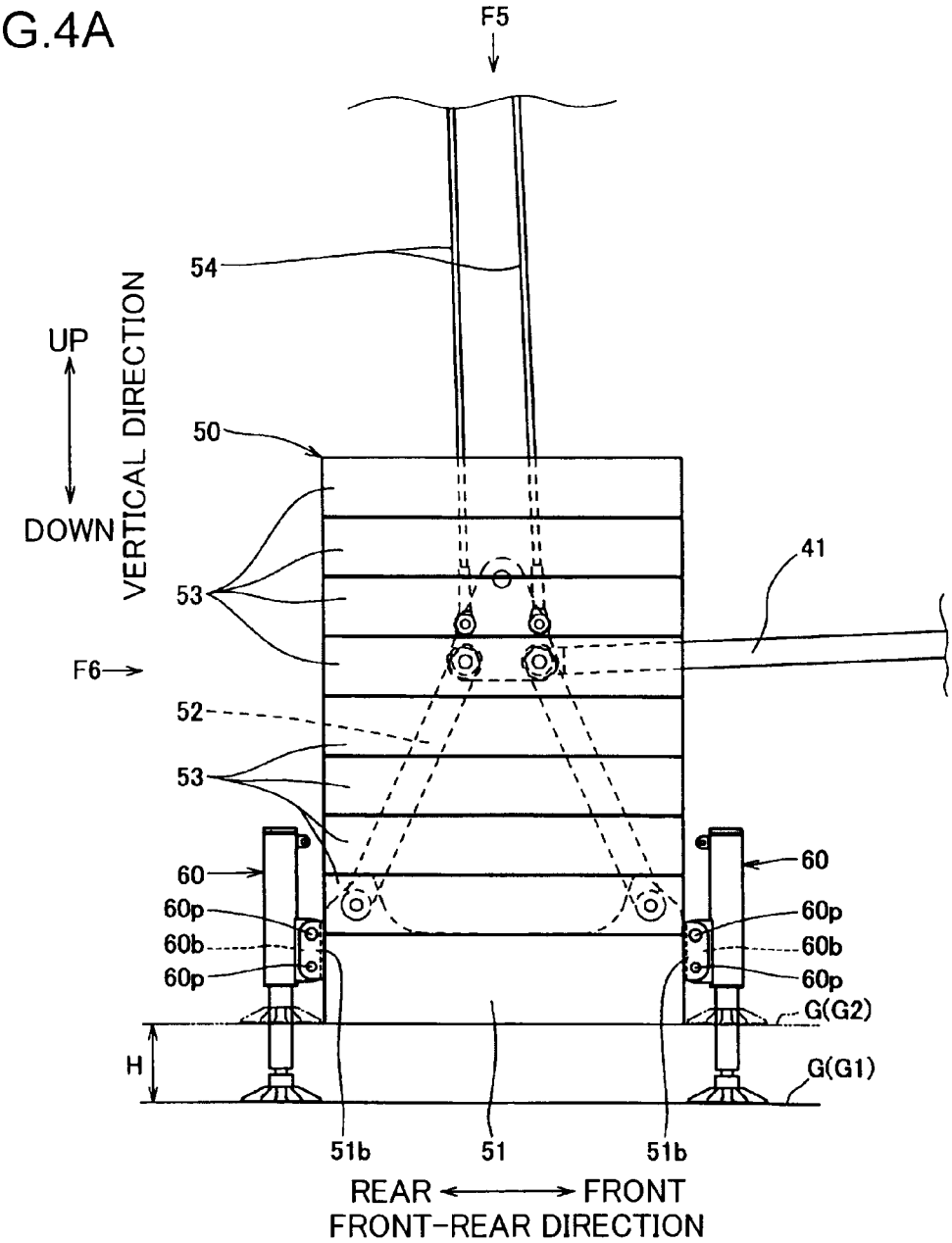
FIG. 4A is an enlarged view of a counterweight in FIG. 1 and components associated therewith, when viewing the counterweight and the associated components in a direction indicated by the arrowed line F4A in FIGS. 5 and 6.

FIG. 1 shows a mobile crane 1. This mobile crane 1 is a counterbalance type crane, having not only upper slewing body-rear end counterweights 22, which are one attached to an rear end of the upper slewing body 20, but also a counterweight 50 (extra counterweight) disposed at the rear of an after-mentioned upper slewing body 20. Specifically, the mobile crane 1 comprises a lower propelling body 10, a upper slewing body 20 slewably mounted on the lower propelling body 10, a boom 25 pivotably attached to the upper slewing body 20, a mast 30 pivotably attached to the upper slewing body 20 at a position rearward of the boom 25, and a pair of right and left counterweight support members 41 attached to a rear end of the upper slewing body 20, the counterweight 50 being hung from the upper end of the mast 30. Furthermore, as shown in FIG. 4A, attached to the counterweight 50 are a plurality of hydraulic cylinders 60 each serving as a counterweight-lifting cylinder.

Figure 2:
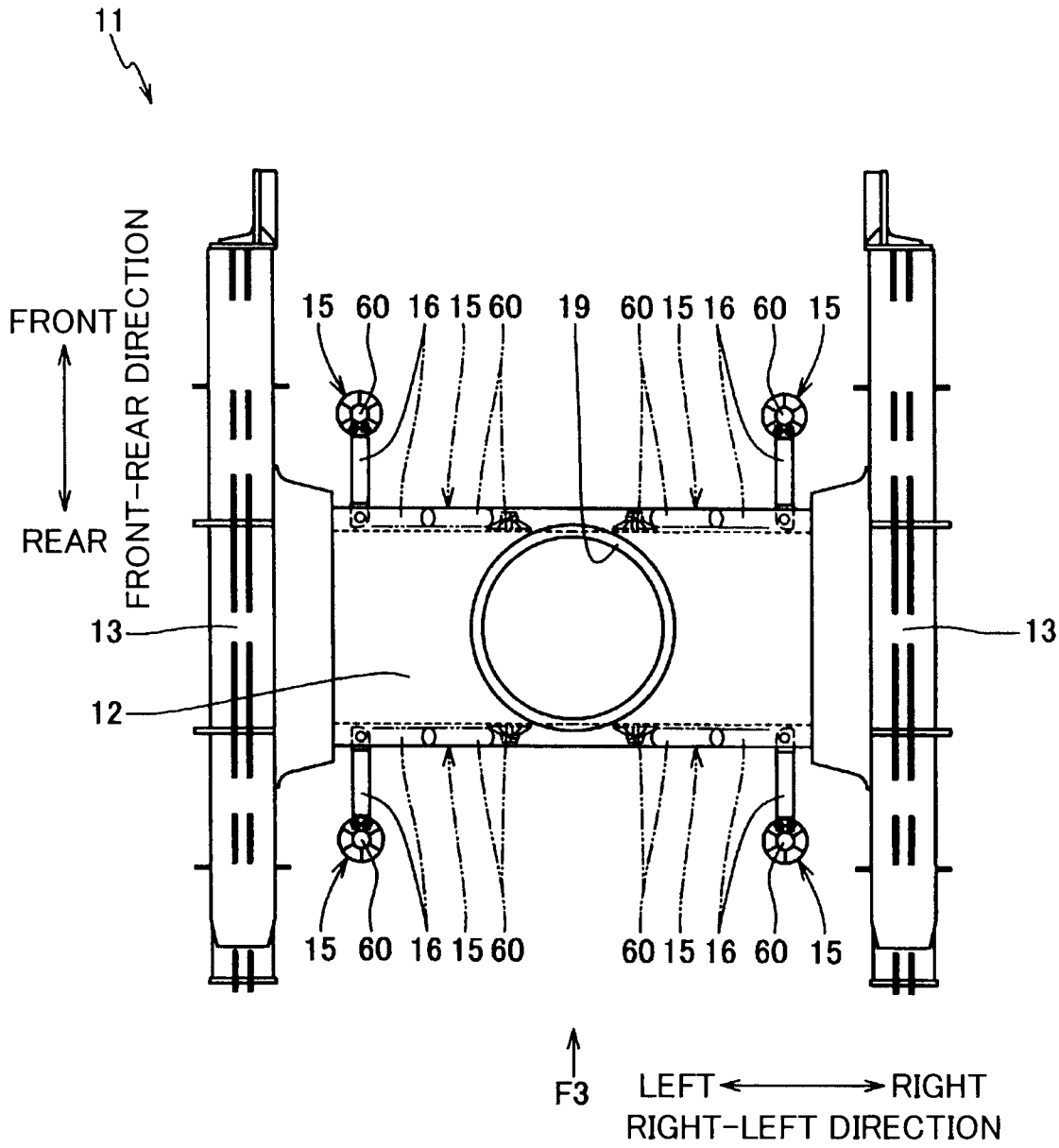
FIG. 2 is a top plan view of a propelling body of the mobile crane, when viewing the propelling body in a direction indicated by the arrowed line F2 in FIG. 3.

The lower propelling body 10 includes a propelling body 11 shown in FIG. 2 and a pair of crawlers 17 (FIG. 1) attached to right and left sides of the propelling body 11 respectively, provided for traveling of the mobile crane 1.

The propelling body 11, as shown in FIG. 2, has a car body 12, a pair of right and left crawler frames 13, and a body lifter 15. The car body 12 makes up a central portion of the propelling body 11, and has a rectangular shape when viewed from thereabove. The crawler frames 13 are arranged respective ones of right and left sides of the car body 12 to extend in a frontward-rearward direction. The crawlers 17 are attached to respective ones of the crawler frames 13. The body lifter 15 is attached to four corners of the car body 12 to lift/lower the lower propelling body 10 during assembling and disassembling of the lower propelling body 10.

The body lifter 15 comprises four arms 16 each having a basal end attached to the car body 12 and adapted to be horizontally rotationally moved about the basal end, and four body lifter cylinders each attached to a distal end of the arms 16 respectively. In this embodiment, the hydraulic cylinders 60 are additionally used as the body lifter cylinders, as described later.

Figure 3:
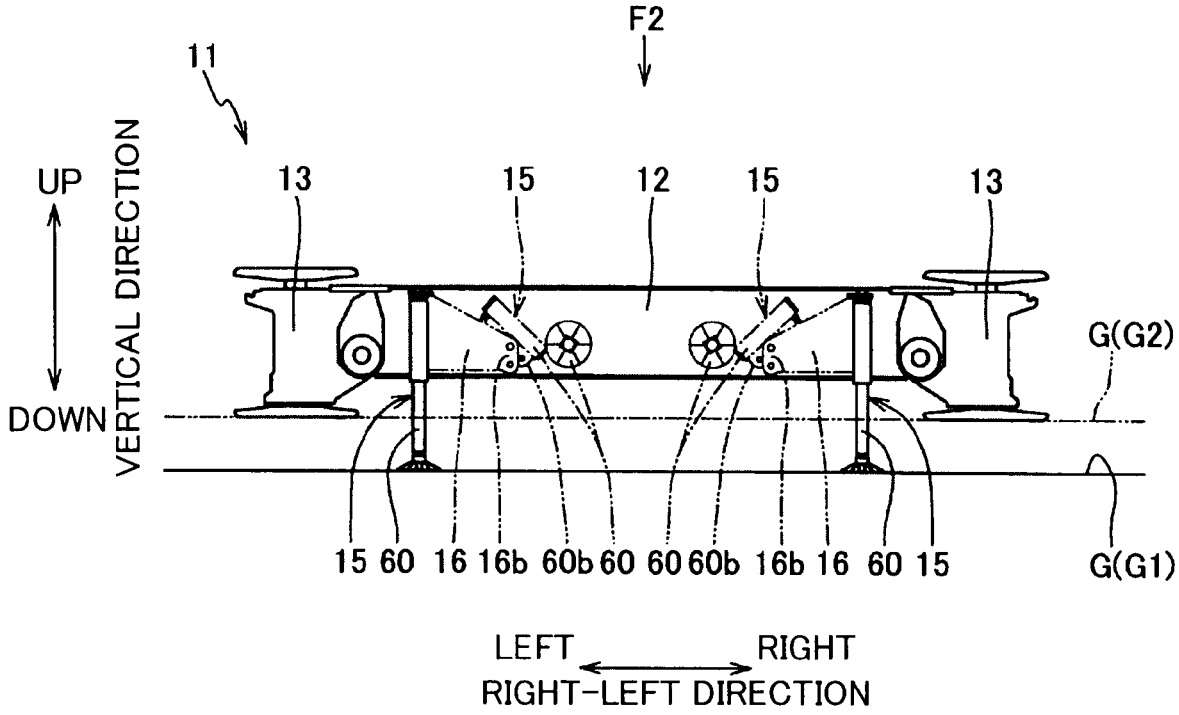
FIG. 3 is a rear view of a propelling body, when viewing the propelling body in a direction indicated by the arrowed line F3 in FIG. 2.

The distal end of the arm 16 is formed as a body-lifter-side cylinder-holding portion, namely a second cylinder-holding portion, adapted to detachably hold the hydraulic cylinder 60 used as the body lifter cylinder. More specifically, as shown in FIG. 3, the arm 16 has an arm-side bracket 16*b*, and the hydraulic cylinder 60, which can be additionally used as the body lifter cylinder, has a cylinder-side bracket 60*b* adapted to be attached to the mounting bracket 16*b*. The brackets 16*b* and 60*b* have respective pin holes, into which respective pins are inserted to fix the hydraulic cylinder 60 to the distal end of the arm 16.

For assembling and disassembling of the lower propelling body 10, the body lifter 15 is extracted from the car body 12 outwardly in the frontward-rearward direction, as indicated by the solid lines in FIG. 2, and then operated to separate the propelling body 11 upward from a ground surface G, as shown in FIG. 3 (it should be noted that FIG. 3 expresses the spacing as a change in position of the ground surface G from G2 to G1). In this state, the crawler frames 13 are attached/detached to/from the car body 12 while the crawlers 17 shown in FIG. 1 are kept attached to the respective crawler frames 13. On the other hand, during a period other than the assembling and disassembling of the lower propelling body 10 (e.g., during transportation of the lower propelling body 10), the body lifter 15 is retracted along front and rear side surfaces of the car body 12, as shown in FIGS. 2 and 3 by the two-dot chain lines.

The upper slewing body 20, as shown in FIG. 1, is supported on the lower propelling body 10 through a slewing bearing 19 so as to be able to be slewed relatively to the lower propelling body 10. The upper slewing body 20 has a rear end portion to which the upper slewing body-rear end counterweight 22 are attached, a front end portion to which the boom 25 is attached, and a portion to which the mast 30 is attached at the rear of the boom 25. Furthermore, there is attached a crane mast 27 to the upper slewing body 20 at a position below and rearward of the mast 30. Besides, mounted to the upper slewing body 20 are an operator cabin 21 and non-illustrated components, such as a engine, a hydraulic pump and a hydraulic line.

Figure 5:
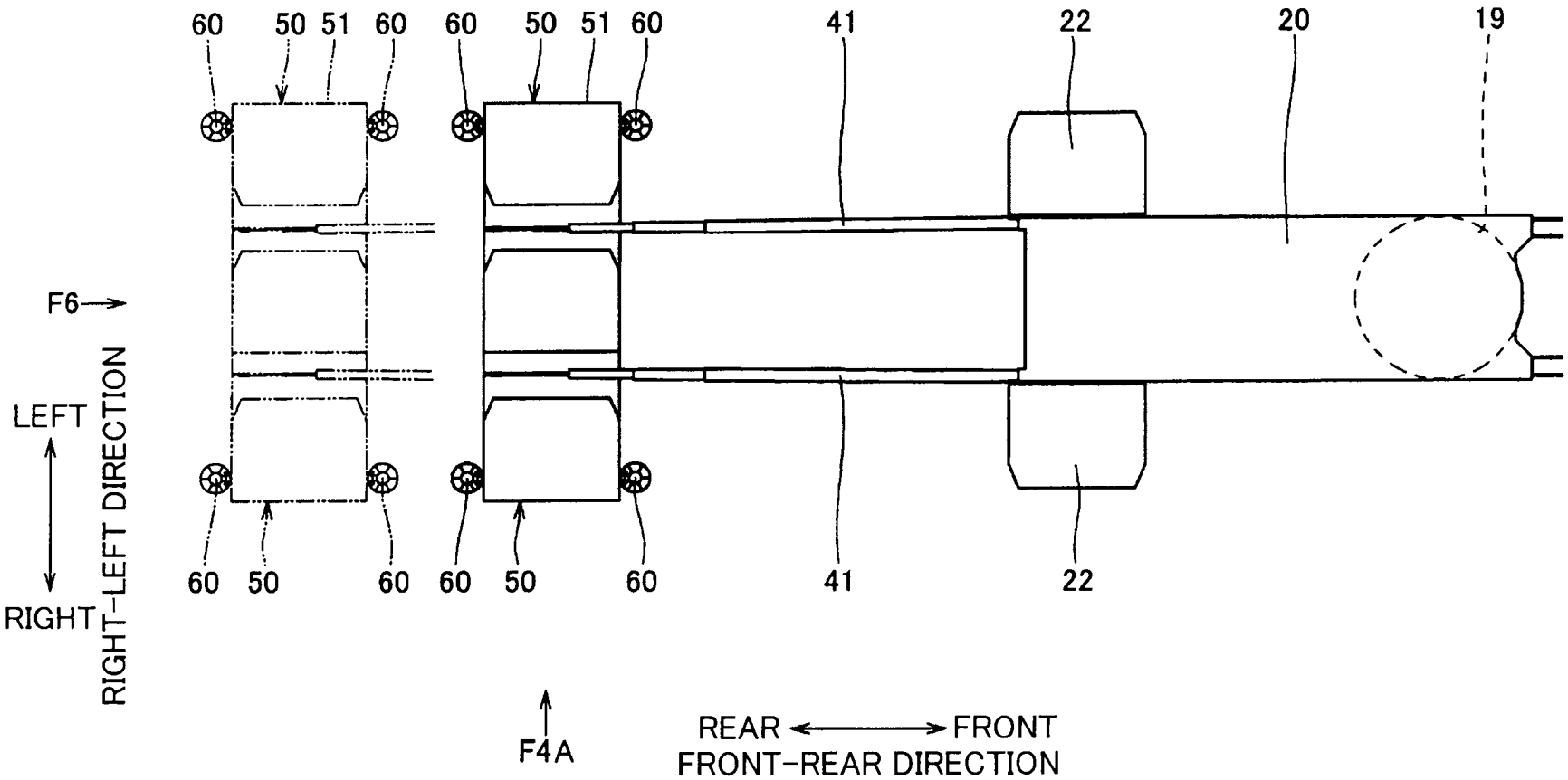
FIG. 5 is a view along the arrowed line F5, wherein the counterweight and the associated components are shown when viewed in a direction indicated by the arrowed line F5 in FIGS. 4A and 6.

The upper slewing body-rear end counterweight 22 are ones for preventing the mobile crane 1 from being inclined frontwardly due to a load hung by a hook 26 to thereby enlarge a lifting capacity of the mobile crane 1. The upper slewing body-rear end counterweights 22 in this embodiment are fixed to right and left side surfaces of the rear end of the upper slewing body 20 respectively, as shown in FIG. 5. The upper slewing body-rear end counterweights 22 are provided separately from the counterweight 50 disposed rearward of the upper slewing body 20 as described in detail later.

The boom 25 is formed in a lattice structure, and attached to the front end of the upper slewing body 20 as shown in FIG. 1 so as to be derrickable with respect to the upper slewing body 20. The boom 25 has a distal end formed as a boom top 25*t*, from which the hook 26 is suspended to hang a load through a wire rope.

The crane mast 27 is a member for raising/lowering the mast 30, having a hollow rectangular cross-section. The crane mast 27 has a basal end attached to the upper slewing body 20 and a distal end located on an opposite side of the basal end, the distal end connected to a drum of a mast-raising/lowering winch (not shown) mounted on the upper slewing body 20 at a position near the rear end thereof, through a mast raising/lowering rope 28.

The mast 30 is a member for raising/lowering the boom 25, having a lattice structure in this embodiment. The mast 30 is disposed at the rear of the boom 25 and at the front of and above the crane mast 27, that is, disposed between the boom 25 and the crane mast 27.

The mast 30 has a basal end serving as a mast foot 30*f* vertically pivotably attached to a portion near the front end of the upper slewing body 20 and a distal end located on an opposite side of the base end and formed as a mast top 30*t*, the mast top 30*t* and the boom top 25*t* interconnected through a boom-raising/lowering wire rope 32 and a boom guy line 33. The boom-raising/lowering wire rope 32 is unreeled from a boom-raising/lowering winch 34 attached to the back surface of the mast 30, and wound between a plurality of mast-side sheaves 35 aligned in a rightward-leftward direction near the mast top 30*t* and a plurality of guy line-side sheaves 36 connected to a rear end of the guy line 33 and arranged in the rightward-leftward direction. The boom-raising/lowering winch 34 is operable to reel or unreel the boom-raising/lowering wire rope 32 while the mast 30 is fixed, thus raising/lowering the boom 25.

The mast 30 is raised and lowered pivotably in accordance with a vertical swinging movement thereof about the mast foot 30*f*. Specifically, the mast top 30*t* and the distal end of the crane mast 27 are interconnected through a mast guy line 31, and the mast-raising/lowering winch is operable to reel or unreel the mast raising/lowering rope 28 to raise and lower the crane mast 27, thereby raising and lowering the mast 30.

The counterweight support members 41, which are so disposed as to extend in the frontward-rearward direction and be aligned in side-by-side relation in the rightward-leftward direction as shown in FIG. 5, are adapted to be extended/retracted so as to forcibly change a hanging radius R of the counterweight 50, i.e., a horizontal distance between the mast foot 30*f* and a center of gravity (gravitational center) of the counterweight 50. Each of the counterweight support members 41 has a front end attached to the rear end of the upper slewing body 20 and a rear end connected to the counterweight 50.

Figure 6:
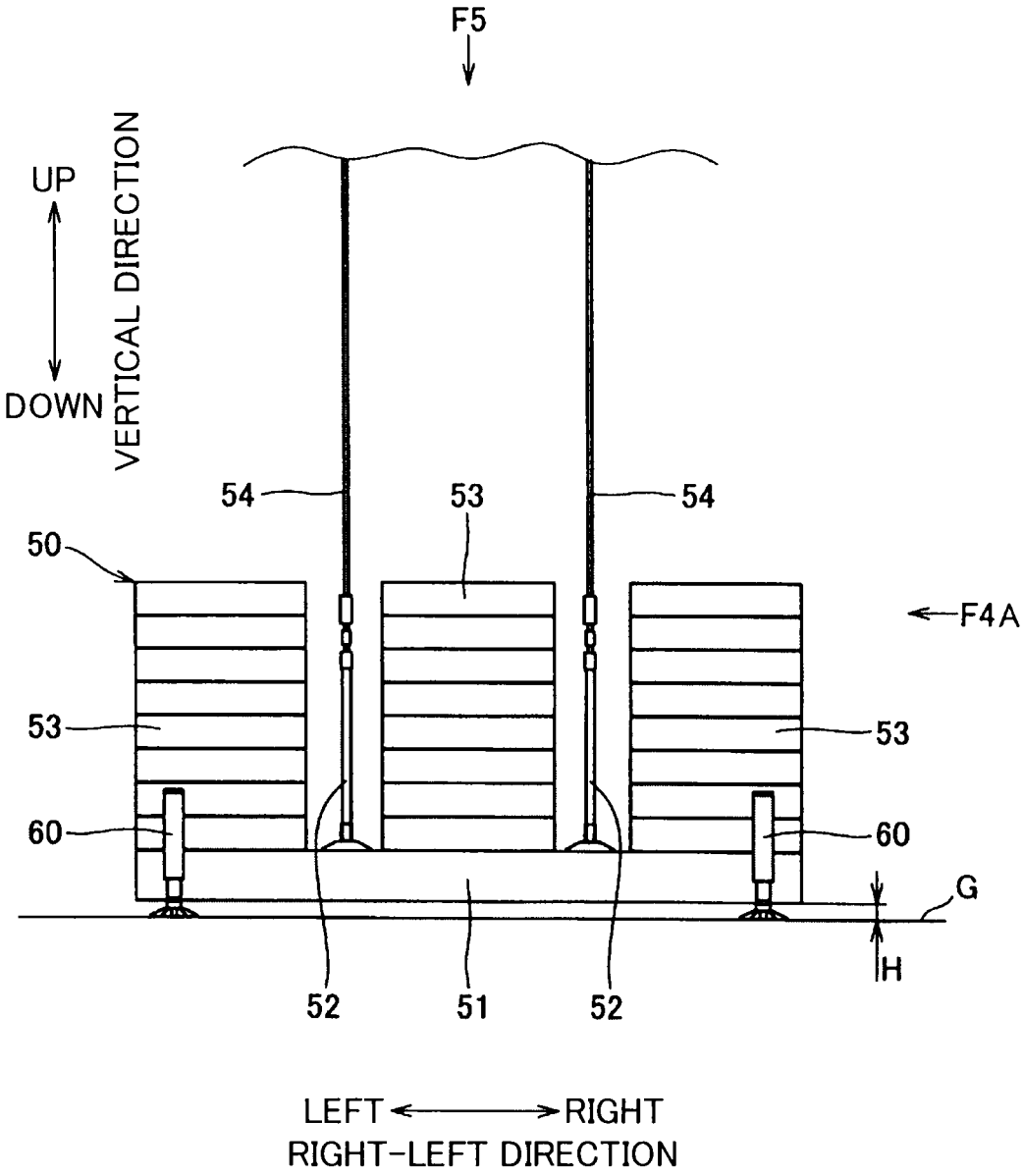
FIG. 6 is a schematic diagram of the counterweight and the associated components, when viewed in a direction indicated by the arrowed line F6 in FIGS. 1, 4A and 5.

The counterweight 50 is a weight which is disposed at the rear of the upper slewing body 20 and hung from the mast 30 through a guy line (counterweight guy line 54), as shown in FIG. 1. The counterweight 50 is provided to suppress the frontward inclination of the mobile crane 1 due to a load hung by the hook 26 to thereby enlarge the lifting capacity of the mobile crane 1. The counterweight 50, which is other than the upper slewing body-rear end counterweight 22, is so-called an "extra counterweight". This means that, when the upper slewing body 20 is slewed under a condition that the counterweight 50 is spaced from the ground surface G, the counterweight 50 is also slewed about the slewing bearing 19. In FIGS. 4A, 5 and 6, the "frontward-rearward direction" and the "rightward-leftward direction" are defined on the basis of the upper slewing body 20.

As shown in FIG. 4A, the counterweight 50 includes a base weight 51 disposed at a lowermost position, a plurality of weight members 53 stacked on the base weight 51, and a connecting mechanism 52 for connecting the counterweight guy line 54 and the base weight 51. In this embodiment, there are set a plurality of stacking regions arranged side-by-side in the rightward-leftward direction (in FIGS. 5 and 6, three regions consisting of a central region, and right and left regions on both sides of the central region); in each of the stack regions, the weight members 53 are stacked on the base weight 51, and a lower end of the connecting mechanism 52 is connected to the base weight 51 at two or more positions (in FIGS. 5 and 6, two right and left positions between adjacent ones of the stacking areas).

The counterweight 50 is hung from the mast 30, as shown in FIG. 1. Specifically, the counterweight guy line 54 is drooped from a mast point 30*p* of the mast top 30*t* in the distal end of the mast 30, and the connecting mechanism 52 is connected to a lower end of the counterweight guy line 54, as shown in FIG. 4A. Through the connecting mechanism 52 and the counterweight guy line 54, the counterweight 50 is hung from the mast 30.

The hanging radius R of the counterweight 50, which is changed according to the extension/retraction of the counterweight support members 41 as shown in FIGS. 1 and 5, is also changed according to the raising and lowering of the mast 30. Meanwhile, because of the constant length of the counterweight guy line 54, the change in the hanging radius R varies the counterweight height H. For example, when the hanging radius R is changed from R1 to R2 as shown in FIG. 1, the counterweight height H is changed from H1 to H2 as shown in FIG. 1.

As shown in FIG. 4A, each of the hydraulic cylinders 60 is also used as a counterweight-lifting cylinder which is attached to the counter weight 50 and is extended so as to vertically push up the counterweight 50 while receiving a reaction force from the ground surface G (in FIG. 4A, the position of the ground surface G is changed from G2 to G1).

Figure 4B:
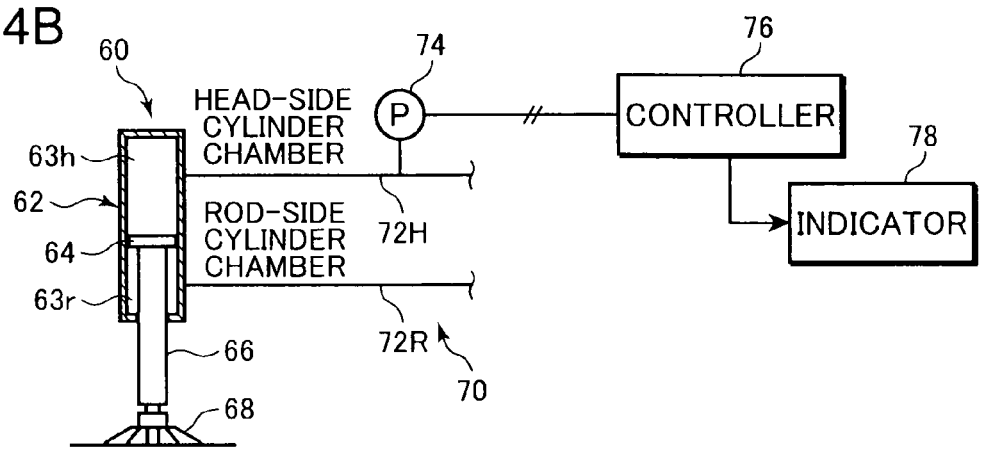
FIG. 4B is a schematic diagram showing a counterweight-lifting cylinder adapted to be attached to the counterweight, and components associated thereto, such as hydraulic lines connected thereto.

Each of the hydraulic cylinders 60 is an oil-hydraulic cylinder, comprising a cylinder body 62, a piston 64, and a rod 66, as shown in FIG. 4B. The cylinder body 62 is a hollow cylindrical-shaped container surrounding an internal space thereof. The piston 64 is provided within the cylinder body 62 to partition the internal space into an upper head-side cylinder chamber 63*h* and a lower rod-side cylinder chamber 63*r*. The rod 66 extends from the piston 64 downwardly beyond a lower end of the cylinder body 62, having a lower end formed as a landing portion 68.

The hydraulic cylinder 60 is connected to a hydraulic circuit 70 mounted, for example, to the upper slewing body 20. The hydraulic circuit 70 has a head-side line 72H connected to the head-side cylinder chamber 63*h*, a rod-side line 72R connected to the rod-side cylinder chamber 63*r*, and a cylinder drive section connected to each of the cylinder chambers 63*h* and 63*r* via a corresponding one of the lines 72H and 72R. The cylinder drive section is adapted to supply a hydraulic fluid into the head-side cylinder chamber 63*h* involving a discharge of a hydraulic fluid from the rod-side cylinder chamber 63*r* to thereby extend the hydraulic cylinder 60, and conversely to supply a hydraulic fluid into the rod-side cylinder chamber 63*r* involving a discharge of a hydraulic fluid from the head-side cylinder chamber 63*h* to thereby retract the hydraulic cylinder 60.

The mobile crane 1 according to this embodiment further comprises a pressure detection sensor 74 operable to detect a hydraulic pressure inside the head-side line 72H, a controller 76 connected to the pressure detection sensor 74, and an indicator 78. The controller 76 is operable to output a command signal to the indicator 78, when a pressure detected by the pressure detection sensor 74 reaches a predetermined value, to instruct the indicator 78 to present information announcing the landing of the landing portion 68. The detected pressure in the landed state corresponds to a mass of the counterweight 50, enabling the controller 74 to present information on a mass of the counterweight, based on the detected pressure, to automatically set a rated load corresponding to the mass, and to present information about the rated load.

To be used as the counterweight-lifting cylinders, the hydraulic cylinders 60 are attached to a side surface of the base weight 51. Specifically, as shown in FIG. 5, the hydraulic cylinders 60 are detachably attached to respective four corners of the base weight 51 in top plan view. In other words, the counterweight 50 has a plurality of counterweight-side cylinder-holding portions each adapted to detachably hold each of the hydraulic cylinders 60 as the counterweight-lifting cylinders, the counterweight-side cylinder-holding portions provided to respective holding position, which are four corners in this embodiment, set on the side surface of the base weight 51. Specifically, as shown in FIG. 4A, there are provided four weight-side brackets 51*b* each having a pin hole, on respective ones of the four corners of the base weight 51, so as to protrude beyond the side surface of the base weight 51 in the frontward-rearward direction correspondingly to the respective cylinder-side brackets 60*b* of the hydraulic cylinders 60. Herein, the hydraulic cylinders 60 are fixed to the base weight 51 by a common pin 60*p* inserted into the pin hole of each of the weight-side brackets 51*b* and the pin hole of the cylinder-side bracket 60*b* corresponding to the weight-side bracket 51*b*.

The extension/retraction of the hydraulic cylinders 60 allows the counterweight 50 to be brought between the landed state and the hung state without pivot movement of the mast 30. For example, even when the counterweight height H is changed due to a change in the hanging radius R (see FIG. 1) of the counterweight 50 as shown in FIG. 1, the extension/retraction of the hydraulic cylinders 60 allows both of the landed state and the hung state to be selected, in spite of the change in the counterweight height H. Specifically, when no load is hung from the boom 25, the hydraulic cylinders 60 are driven to be extended so as to let the respective landing portions 68 of the hydraulic cylinders 60 land on the ground surface G (G1), thereby preventing the mobile crane 1 from rearward inclination due to the mass of the counterweight 50. On contrary, when a load is hung from the boom 25 (see FIG. 1), the hydraulic cylinders 60 are driven to be retracted so as to let the hydraulic cylinders 60 and the base weight 51 to be apart from the ground surface G (G1), thereby enabling the counterweight 50 to serve as a weight to prevent the mobile crane 1 from frontward inclination.

In this embodiment, the hydraulic cylinders 60 can also function as the body lifter cylinders shown in FIGS. 2 and 3. Specifically, for assembly and disassembly of the lower propelling body 10 shown in FIG. 1, the hydraulic cylinders 60 are attached to respective ones of the distal ends of the arms 16 in the body lifter 15 of the propelling body 11 to serve as the body lifter cylinders, as shown in FIGS. 2 and 3. On the other hand, in a crane operation, the hydraulic cylinders 60 are detached from the arms 16 in the body lifter 15 of the propelling body 11 and attached to the base weight 51 of the counterweight 50 shown in FIG. 4A to serve as the counterweight-lifting cylinders.

Figure 7:
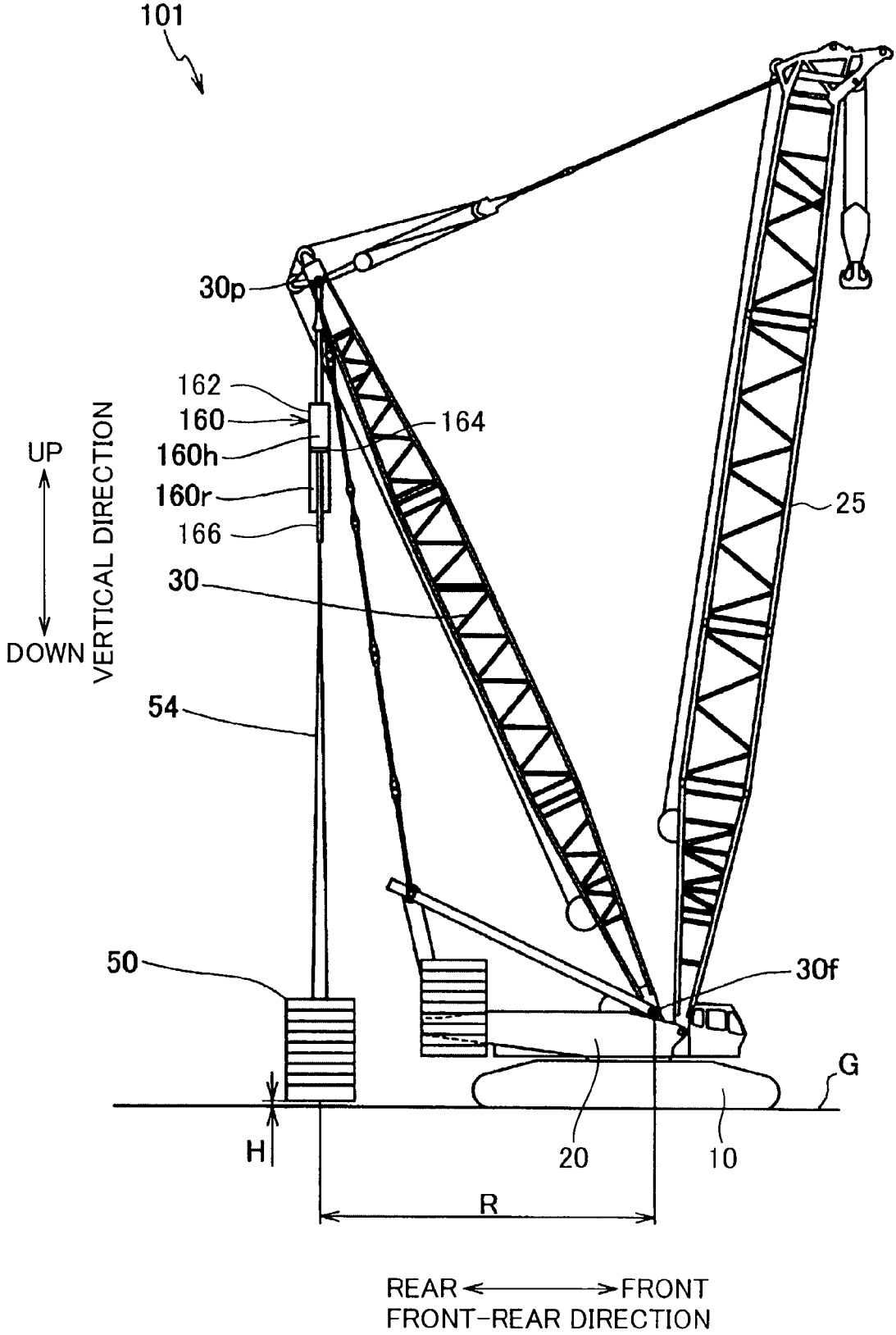
PRIOR ART FIG.7
FIG. 7 is a front view showing a conventional mobile crane.
Figure 8:
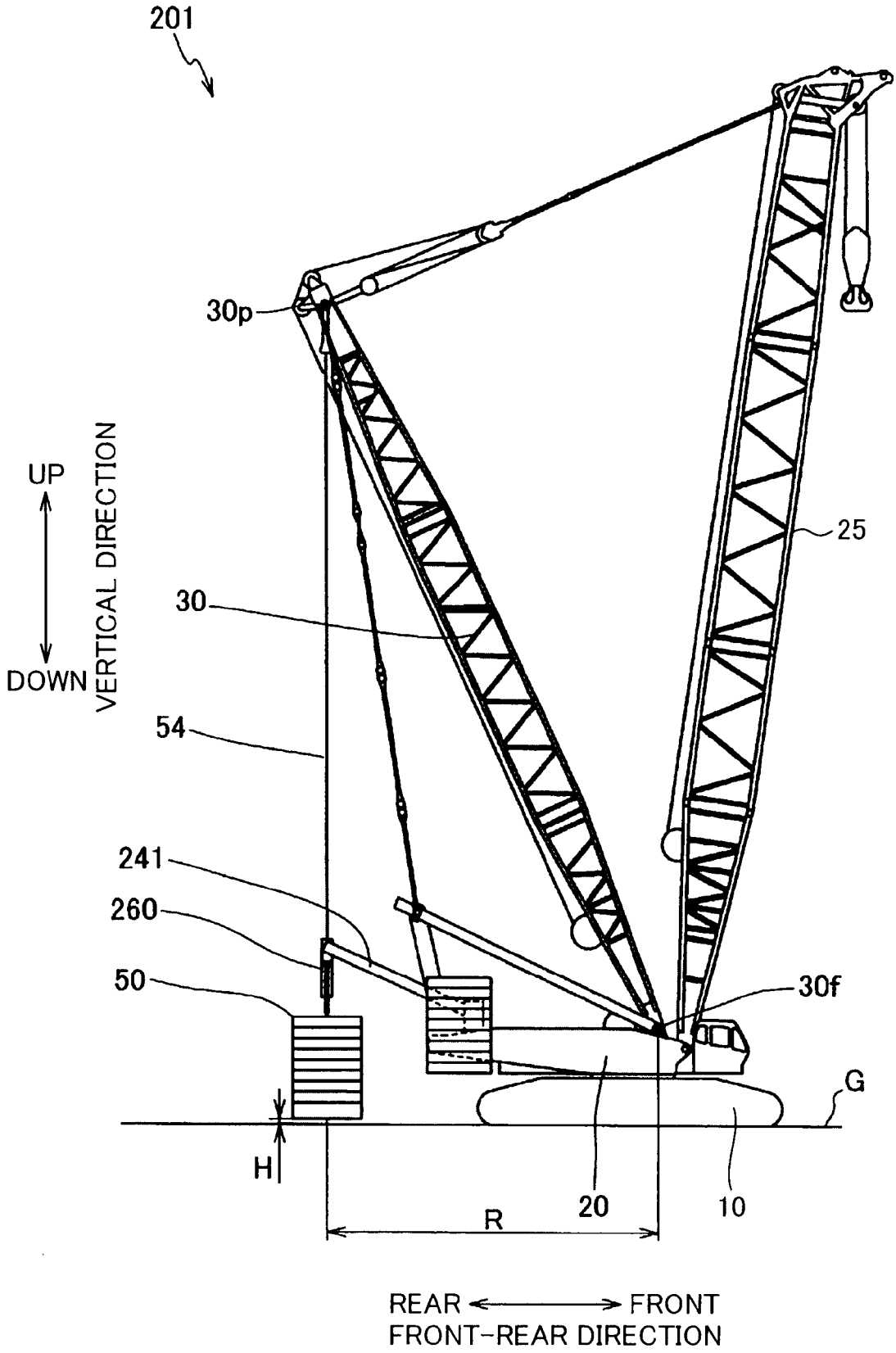
PRIOR ART FIG.8
FIG. 8 is a front view showing another conventional mobile crane.

In the above mobile crane 1, each of the hydraulic cylinders 60, attached to the counterweight 50 so as to vertically push up the counterweight 50 while receiving a reaction force from the ground surface by its extension, can be driven in a high efficiency, for example, as compared with the hydraulic cylinders 160 and 260 as shown in FIGS. 7 and 8. Specifically, either of the hydraulic cylinders 160 and 260 is required to be retracted to pull up a counterweight 50 against a gravity acting on the counterweight 50, the retraction requiring a supply of a hydraulic pressure into a rod-side cylinder chamber 160*r* having a pressure receiving area less than that of a head-side cylinder chamber 160*h* (see FIG. 7). In contrast, in the mobile crane 1 according to the above embodiment, each of the hydraulic cylinders 60 is so disposed as to extend to push up the counterweight 50 against a gravity acting on the counterweight 50, and the extension can be performed by the supply of the hydraulic pressure into the head-side cylinder chamber 63*h* having a relatively large pressure receiving area. This allows the hydraulic cylinder 60 in the above embodiment to lift the counterweight 50 with a low hydraulic pressure or with a small cylinder diameter, as compared with the hydraulic cylinders 160 and 260 used to pull up the counterweight 50. This permits a low-cost type to be used as the hydraulic cylinder 60.

Furthermore, in the mobile crane 1 according to the above embodiment, the output signal of the pressure detection sensor 74 can provide accurate information about whether the counterweight 50 is landed or not. For example, when a load starts to be gradually lifted up by the boom 25 shown in FIG. 1 under a condition that the counterweight 50 is landed, the counterweight 50 is gradually brought into separation from the ground surface: the separation lowers a pressure detected by the pressure detection sensor 74, i.e., an internal pressure of the head-side cylinder chamber 63*h* of the hydraulic cylinder 60. The detection signal output from the pressure detection sensor 74 is, therefore, a signal useful to determine (i) whether the counterweight 50 is fully landed on the ground surface G, (ii) whether the counterweight 50 is lifted although the landing portion 68 of the hydraulic cylinder 60 is in contact with the ground surface G, or (iii) whether the counterweight 50 and the hydraulic cylinder 60 are fully spaced from the ground surface G. Accordingly, based on the detection signal, the controller 74 can provide accurate information to an operator of the mobile crane 1.

This allows the cost on the mobile crane 1 to be lowered. In a conventional mobile crane, there is required a dedicated limit switch for detecting the landing of the counterweight 50, as shown, for example, in FIGS. 4 to 8 of the JP 2008-297112 A. In contract, the mobile crane 1 according to the above embodiment permits the landing to be detected based on a change in the internal pressure of the head-side cylinder chamber 63*h*, by no use of dedicated detection means such as a limit switch.

Moreover, the mobile crane 1 can possess a high safety. A conventional mobile crane requires manual operation for input of a mass of the counterweight, in order to set its crane capacity. In contrast, in the mobile crane 1 according to the above embodiment, the controller 76 can figure out a mass of the counterweight 50 based on a pressure detected by the pressure detection sensor 74 and therefore can automatically set a capacity associated with the mass of the counterweight 50 (e.g., a rated load); thus, manual input is not needed. This results in no erroneous input and high crane safety. Specifically, in the mobile crane 1, a pressure detected by the pressure detection sensor 74 when the landing portion 68 of each of the hydraulic cylinders 60 is landed though the counterweight 50 is spaced from the ground surface G (when the counterweight 50 is not lifted up by the counterweight guy line 54) as shown in FIG. 4A corresponds to a mass of the counterweight 50.

In addition, the mobile crane 1 according to the above embodiment, where the hydraulic cylinders 60 to be used as both of body lifter cylinders for lifting/lowering the lower propelling body 10 during the assembling/disassembling of the lower propelling body 10 and counterweight-lifting cylinders to be attached to the counterweight 50 (see FIG. 4A) during the crane operation, is reduced in cost, as compared with a mobile crane using a dedicated hydraulic cylinder for each of the counterweight-lifting cylinders.

Furthermore, the mobile crane 1, where the hydraulic cylinders 60 are attached to the counterweight 50 located at a relatively low position, permits the hydraulic cylinders 60 to be easily attached, as compared with the cylinders 160 and 260, either of which is provided between the counterweight 50 and the mast point 30*p* of the mast 30, as shown in FIGS. 7 and 8. This results in easy assembly of the mobile crane 1. For example, if the hydraulic cylinder 60 was attached in a vicinity of the upper end of the mast 30, the mast 30 should be lowered. However, in the mobile crane 1 shown in FIG. 1, the attachment of the hydraulic cylinders 60 can be easily performed on the ground without the lowering of the mast 30.

While the above embodiments according to the present invention have been graphically disclosed, the present invention is not limited to the specific structure of the embodiment, but various changes and modifications may be made therein without departing from the spirits and scope of the invention, for example, as follows.

There may be additionally provided a jib on the side of the distal end of the boom 25 shown in FIG. 1.

The present invention may be applied to a wheel-type mobile.

The present invention permits the counterweight support members 41 shown in FIG. 1 to be omitted.

The present invention is not limited to the specific number and the attaching positions of the counterweight-lifting cylinders (in the above embodiment, the hydraulic cylinders 60); for example, the number of the counterweight-lifting cylinders to be attached to the counterweight can be three or less, or may be five or more.

The attaching positions of the counterweight-lifting cylinders are not limited to the base weight 51. For example, the counterweight may include a loading board for allowing the base weight to be placed thereon, wherein the counterweight-lifting cylinders are attached to the loading board. Alternatively, the counterweight and the cylinder body of each of the counterweight-lifting cylinders may be integrally formed.

As described above, the present invention provides a mobile crane capable of adjusting a counterweight height without use of a costly hydraulic cylinder. The mobile crane comprises: a lower propelling body; a upper slewing body slewably mounted on the lower propelling body; a boom attached to the upper slewing body pivotably; a mast disposed at the rear of the boom and adapted to be raised and lowered so as to raise and lower the boom; a counterweight disposed at the rear of the upper slewing body and hung from the mast through a guy line; and a counterweight-lifting cylinder attached to the counterweight and adapted to be extended so as to vertically push up the counterweight while receiving a reaction force from a ground surface. The counterweight-lifting cylinder has a cylinder body surrounding an internal space thereof, a piston provided within the cylinder body to separate the internal space into an upper head-side cylinder chamber and a lower rod-side cylinder chamber, and a rod extending from the piston downwardly beyond an lower end of the cylinder body, the counterweight-lifting cylinder being adapted to be extended by supply of a hydraulic pressure into the head-side cylinder chamber and to be retracted by supply of a hydraulic pressure into the rod-side cylinder chamber.

In the mobile crane of the present invention, the counterweight-lifting cylinder can vertically push up the counterweight on a ground surface against gravity acting on the counterweight, by supply of a hydraulic pressure into the head-side cylinder chamber of the counterweight-lifting cylinder which has a pressure receiving area greater than that of the rod-side cylinder chamber. This allows the counterweight-lifting cylinder to be driven in high efficiency, as compared with a cylinder required to be retracted to pull up a counterweight against a gravity acting thereon, i.e., a cylinder in which a hydraulic pressure is supplied into a rod-side cylinder chamber having a relatively small pressure receiving area to pull up the counterweight, as in the cylinders 160 and 260 shown in FIGS. 7 and 8. This makes it possible to lift the counterweight with a reduced hydraulic pressure or a reduced cylinder diameter, thereby permitting a low-cost hydraulic cylinder to be used to lift/lower the counterweight.

It is preferable that the mobile crane of the present invention further comprises a pressure detection sensor operable to output a detection signal indicative on an internal pressure of the head-side cylinder chamber of the counterweight-lifting cylinder. The detection signal of the pressure detection sensor contributes to provision of information about a landing state of the counterweight. Since the upward movement of the counterweight from the ground surface along with lifting of a load by the boom lowers the internal pressure of the head-side cylinder chamber of the counterweight-lifting cylinder, the detection signal can be utilized for determination, for example, on: whether the counterweight is fully landed on the ground surface; whether the counterweight starts to be lifted although the counterweight-lifting cylinder is in contact with the ground surface; or whether the counterweight and the counterweight-lifting cylinder are fully apart from the ground surface.

The above mobile crane may further comprise an indicator adapted to indicate information about the detection signal, which enables the information to be announced, for example, to an operator (manipulator) of the mobile crane.

While a conventional mobile crane must have a limit switch for detecting whether a counterweight is landed, to provide information of the landing, the above-mentioned pressure detection sensor allows the landed state of the counterweight to be figured out based on the internal pressure of the head-side cylinder chamber of the counterweight-lifting cylinder, thus permitting the dedicated limit switch for detection of the landing to be not used, and permitting a cost of the mobile crane to be reduced.

In addition to the pressure detection sensor, the mobile crane preferably comprises a controller operable to set a mobile crane capacity associated with to a mass of the counterweight, based on the detection signal from the pressure detection sensor. While the conventional mobile crane requires a manual input operation on a mass of the counterweight to set a mobile crane capacity, the combination of the above pressure detection sensor and the controller enable a capacity associated with a mass of the counterweight to be automatically set by utilization of a relative relationship between the mass of the counterweight and the internal pressure of the head-side cylinder chamber of the counterweight-lifting cylinder, thus allowing the manual input of the mass of the counterweight to be not required. This results in no erroneous input of the mass of the counterweight and high crane safety.

In the mobile crane of the present invention, it is possible to use the counterweight-lifting cylinder also as a body lifter cylinder to be attached to the lower propelling body to lift/lower the lower propelling body during assembling/disassembling of the lower propelling body. Specifically, it is preferable that the counterweight has a first cylinder-holding portion (i.e., counterweight-side cylinder-holding portion) adapted to detachably hold the counterweight-lifting cylinder, and the lower propelling body has a second cylinder-holding portion (i.e., lower propelling body-side cylinder-holding portion) adapted to detachably hold the counterweight-lifting cylinder in such a posture that the extension and the retraction of the counterweight-lifting cylinder lifts or lowers the lower propelling body respectively during assembling and disassembling of the lower propelling body.

The additional use of the counterweight-lifting cylinder as the body lifter cylinder permits a cost of the mobile crane to be reduced, as compared with a mobile crane equipped with dedicated cylinders for respective ones of the body lifter cylinder and the counterweight-lifting cylinder. Furthermore, since the counterweight-lifting cylinder is attached to the counterweight originally located at a relatively low position, the attachment of the counterweight-lifting cylinder can be easily performed, as compared with, for example, a cylinder to be disposed between the counterweight and the mast. This allows the mobile crane to be easily assembled. If the counterweight-lifting cylinder was disposed in or in a vicinity of the mast, there would be required a heavy operation for lowering the mast; the counterweight-lifting cylinder in the present invention can be easily attached to the counterweight without the lowering of the mast.

More specifically, preferable is that: the counterweight includes a base weight connected to the guy line and a plurality of weight members stacked on the base weight; the base weight having a side surface on which a plurality of holding positions; and the first cylinder-holding portion is provided to each of the holding positions. The counterweight-lifting cylinder held by each of the first cylinder-holding portions can push up the entire counterweight including the base weight from the ground surface.

This application is based on Japanese patent application serial no. 2010-026533, filed in Japan Patent Office on Feb. 9, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A mobile crane comprising:

a lower propelling body;

an upper slewing body slewably mounted on the lower propelling body;

a boom attached to the upper slewing body pivotably with respect to the upper slewing body;

a mast disposed rearward of the boom and adapted to be raised and lowered so as to raise and lower the boom;

a counterweight disposed at the rear of the upper slewing body and adapted to be hung from the mast through a guy line;

a counterweight-lifting cylinder attached to the counterweight so as to be extended to vertically push up the counterweight while receiving a reaction force from a ground surface, the counterweight-lifting cylinder having a cylinder body surrounding an internal space thereof, a piston provided within the cylinder body so as to partition the internal space into an upper head-side cylinder chamber and a lower rod-side cylinder chamber, and a rod extending from the piston downwardly beyond a lower end of the cylinder body, the counterweight-lifting cylinder being adapted to be extended by supply of a hydraulic pressure into the head-side cylinder chamber and to be retracted by supply of a hydraulic pressure into the rod-side cylinder chamber;

a pressure detection sensor operable to output a detection signal indicative on an internal pressure of the head-side cylinder chamber of the counterweight-lifting cylinder; and a controller operable to set a rated load, based on the detection signal from the pressure detection sensor.

2. The mobile crane as defined in claim 1, which further comprises an indicator adapted to indicate information about the detection signal.

* * * * *